United States Patent [19]

Suga

[11] 4,243,833

[45] Jan. 6, 1981

[54] CARBON ELECTRODE FOR ARC LAMP

[76] Inventor: Nagaichi Suga, 2 Toyama-cho, Shinjuku-ku, Tokyo, Japan

[21] Appl. No.: 55,197

[22] Filed: Jul. 2, 1979

[30] Foreign Application Priority Data

Apr. 13, 1979 [JP] Japan ..... 54-044187

[51] Int. Cl.[3] ..... H05B 31/08; H05B 7/07

[52] U.S. Cl. ..... 13/18 C; 314/60

[58] Field of Search ..... 13/18 C, 18 R; 314/60; 313/357

[56] References Cited

U.S. PATENT DOCUMENTS

| | | | |
|---|---|---|---|
| 3,072,558 | 1/1963 | Myers et al. | 13/18 C X |
| 3,084,419 | 4/1963 | Doetsch et al. | 13/18 C X |
| 3,187,089 | 6/1965 | Cosby et al. | 13/18 C X |
| 3,921,023 | 11/1975 | Valchev et al. | 13/18 C X |
| 4,002,942 | 1/1977 | Gaboury | 13/18 C X |

*Primary Examiner*—Roy N. Envall, Jr.

*Attorney, Agent, or Firm*—Wenderoth, Lind and Ponack

[57] ABSTRACT

A carbon electrode for an arc lamp comprising a plurality of carbon rods joined together in desired length by use of an adhesive comprising metal or carbon powder or mixture thereof and method for preparation of said electrode.

8 Claims, 8 Drawing Figures

CARBON ELECTRODE FOR ARC LAMP

BACKGROUND OF THE INVENTION

This invention relates to an electrode for an arc lamp suitable, for example, as a carbon electrode for weather- and light-resistance testing.

The conventional electrode for arc lamps for weather-and light-resistance testing (hereinafter simply referred to as the "weathering test") is expensive and is rapidly consumed. When consumed below a predetermined length, the electrode must be discarded and replaced by a fresh one. In discarding the used electrode, it must be subjected to high temperatures in a combustion treatment which markedly damages the furnace in which such treatment is performed. Hence, it is by no means easy to dispose of the used electrode.

In the case of an ordinary ultraviolet weatherometer, for example, two lower electrodes each having a length of 100 mm are positioned to oppose an upper electrode having a length of 305 mm and are caused to alternately discharge and generate the arc. In the single discharge for 24 hours, the length of the upper electrode is reduced from 305 mm to about 190 mm while that of the lower electrodes is reduced from 100 mm each to 76 mm. At this time all the electrodes must of replaced by fresh electrodes, respectively. In this instance, the used upper electrode having the reduced length of 190 mm may be cut to 100 mm and used as one of the lower electrodes but the rest must be supplied afresh. This is of course very disadvantageous economically. Moreover, the used electrodes having the length of not greater than 100 mm can neither be further used nor burnt at a temperature below 2,000° C. Hence, their disposal has, to date, been another serious problem.

Despite these problems, it has never been conventionally contemplated to use the used electrodes again by joining them together. This is quite understandable in view of the fact that when the electrodes are simply joined together, the spectral composition would naturally become unstable because the voltage used is so high that the discharge occurs at the joint portion.

OBJECTS AND BRIEF SUMMARY OF THE INVENTION

In view of the foregoing, it is an object of this invention to provide, in an economical manner, an electrode having a stable spectral composition, low consumption ratio and prolonged service life, by effectively utilizing a used electrode or an electrode of such short length that it would conventionally have been discarded.

As a result of intensive studies, the present inventor has surprisingly found that when a plurality of short electrodes are joined together, using a specific adhesive and applied with an auxiliary structure of a suitable length, there is obtained an electrode which not only has a stable spectral composition but also a smaller consumption ratio at discharge, thereby prolonging its service life.

The present invention is based on the foregoing finding.

DETAILED DESCRIPTION OF THE INVENTION

The adhesive to be used in the present invention is obtained by kneading metal particles, carbon powder or the like with a resin and a solvent for the resin.

When metal particles are used, the preferred examples include aluminum, silver, copper, zinc etc. Although not restricted particularly, these metals are used in the powder form having a particle size of 200 to 300 mesh.

The resin to be used is one which is bondable to carbon or a binder of such kind. Preferred examples of the resin are an acrylic resin, an epoxy resin, a polystyrene resin, polyvinyl acetate, polyvinyl alcohol etc. However, it is not preferred to use those compounds which generate chlorine gas or other noxious gases at the time of burning.

As a solvent for the resin, it is possible to use ordinary solvents such as methyl ethyl ketone, ethyl acetate or other solvents which serve as a thinner for the resin.

The resin and the solvent are used as the binder also when only the carbon powder is used without any metal.

Figure 2:
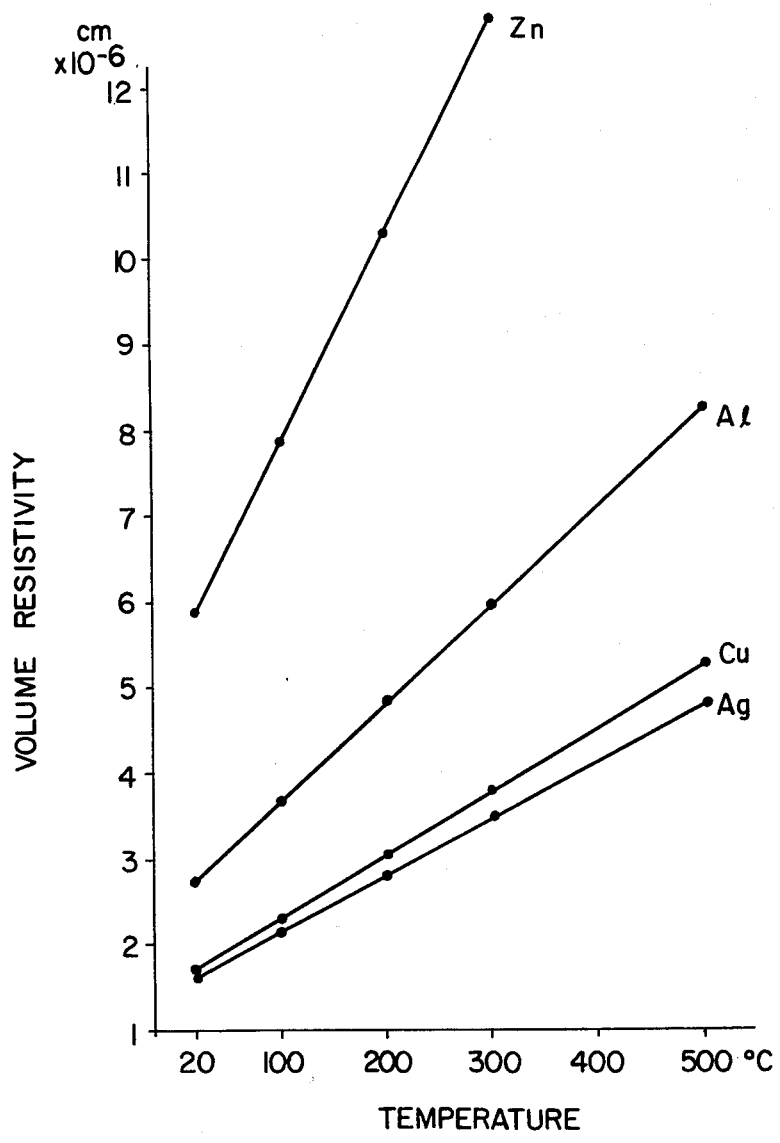
FIG. 2 is a diagram depicting the relationship between the temperature rise of the metal and the volume resistivity.

The metal-containing adhesive to be used in the present invention is listed above and the carbon powder is added in this case to function as a resistance-adjuster at the time of the temperature rise. In other words, as illustrated in FIG. 2, the metal powders such as silver, copper, aluminum, etc. increase in resistance with the temperature rise whereas pure carbon decreases in resistance with an increasing temperature as can be clearly seen from (4) of FIG. 4. It is thus possible to properly adjust the increment of resistance of the metal by the addition of the carbon powder. Because of the presence of such a joint portion, the electrode of the invention has less of a decrease in resistance with the temperature rise and less consumption, as a whole, in comparison with an electrode consisting solely of the pure carbon without any joint portion.

The object of the invention can also be accomplished when the carbon powder contains the adhesive, by adjusting its quantity and mesh size.

Figure 1:
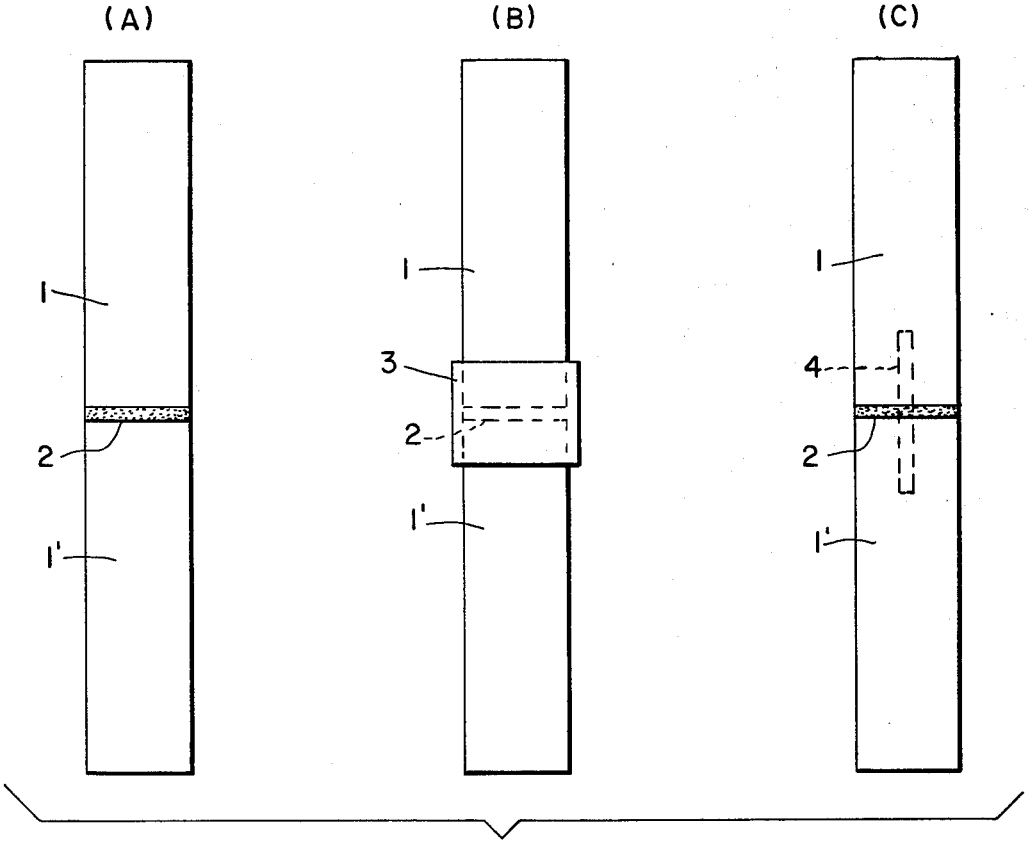
FIG. 1 is a front view of an embodiment of the present invention.

The joint portion in the present invention can be formed in the following manner. Namely, the edge faces of the carbon electrode rods 1, 1' are joined together using the adhesive layer 2 as shown in FIG. 1(A). Further, a metal ring 3 may be fitted around the joint portion as shown in FIG. 1(B). Alternatively, a thin hole is bored at the center of the joint face of each electrode 1, 1' and a metal core 4 such as a rod, a screw having both ends tapped or a stud is fitted into the thin holes for joining the electrodes together as shown in FIG. 1(C).

The number of electrodes to be joined may be greater than 2 and their lengths may vary from each other. In any case, the electrodes should be joined to provide a required length. The present invention may be applied to electrodes whether they have a core or not, and of course to a ultraviolet carbon electrode and to a sunshine carbon electrode.

Figure 3:
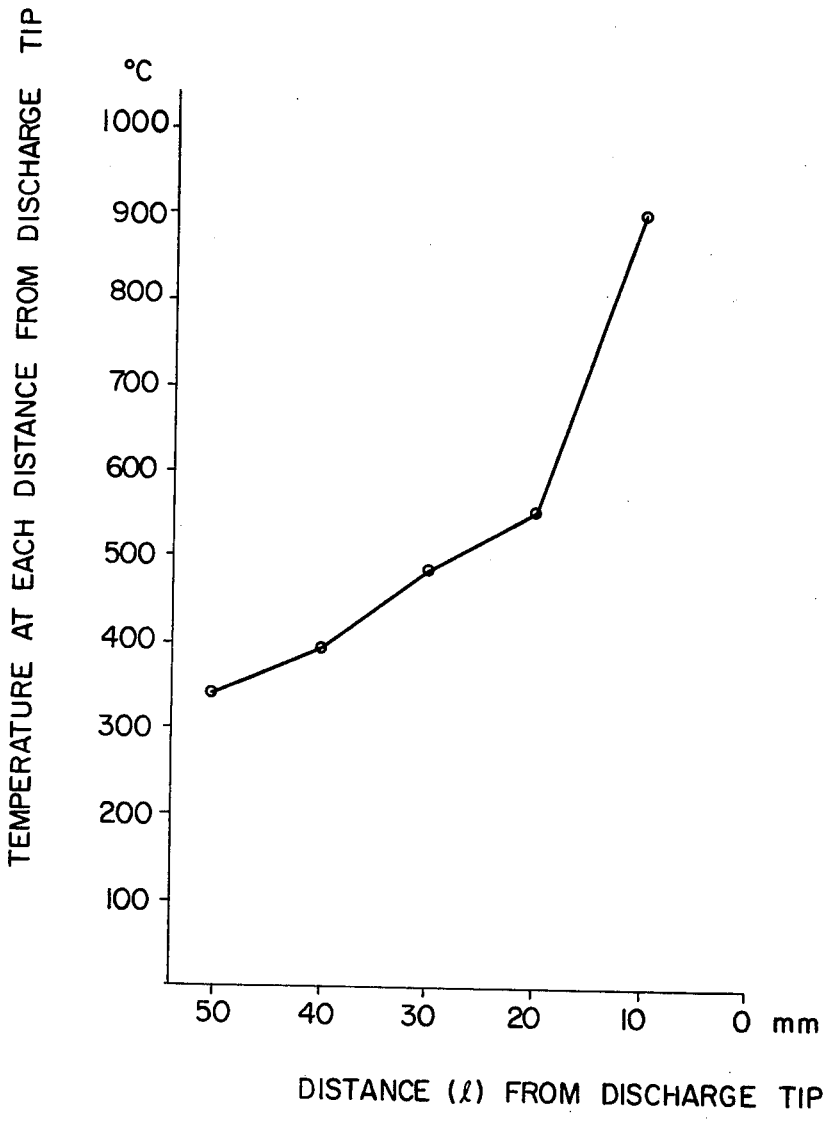
FIG. 3 is a diagram depicting the relationship between the consumption of the U.V. carbon and the temperature change in the joint portion.

FIG. 3 is a diagram showing the temperature change at the joint portion when two used U.V. carbon electrodes, of 50 mm size are joined together in accordance with the present invention. When discharge is carried out using this joined electrode, the carbon is gradually consumed as the discharge progresses and the tip of the electrode gradually approaches the joint portion while the temperature of the joint portion gradually elevates.

The action and effect of the present invention will be explained further with reference to examples thereof.

Two used non-core carbon electrodes, each having a length of 50 mm and a diameter of 13 mm, are joined together using each of the adhesive compositions (1) through (5) of the Table below obtained by dissolving an epoxy resin in a thinner and by a composition consisting of carbon powder, the resin and the solvent. Discharge tests are then performed on the electrodes thus joined.

The resistance of the joined carbon electrodes of the present invention before use and after 24 hours use (resistance over 60 mm of residual length) is illustrated in the Table. The difference in resistance before and after such use for each testpiece is within 12 mω.

TABLE

| | Adhesive composition (weight ratio) | | | | | Resistance | |
|---|---|---|---|---|---|---|---|
| | resin % | solvent % | Ag powder % | Al powder % | C powder % | Before use (80 mm of a 100 mm electrode) mΩ | After 24 hours' use (60 mm of residual length) mΩ |
| (1) | 10 | 30 | 60 | — | — | 42.29–44.58 | 30.22–32.48 |
| (2) | 10 | 29 | 58.5 | — | 2.5 | 42.44–44.79 | 30.33–32.75 |
| (3) | 20 | 60 | — | 20 | — | 50.56–52.86 | 38.45–40.80 |
| (4) | 20 | 58 | — | 19.5 | 2.5 | 50.78–53.11 | 38.65–41.00 |
| (5) | 9.5 | 27.5 | 55 | 4.5 | 3.5 | 47.23–53.33 | 35.09–41.29 |
| fresh electrode | no joint | | (conventional electrode) C powder | | | | |
| (6) | 3.6 | 65.3 | 31.1 | | small coating amount | 53.1 | 41.3 |

| | Residual length after 24 hours' use mm | Consumed length at 24 hours mm | Consumption ratio mm/hr | Spectral distribution |
|---|---|---|---|---|
| (1) | 80 | 20 | 0.83 | equivalent to prior art |
| (2) | 81 | 19 | 0.79 | equivalent to prior art |
| (3) | 85 | 15 | 0.63 | equivalent to prior art |
| (4) | 86 | 14 | 0.58 | equivalent to prior art |
| (5) | 84 | 16 | 0.67 | equivalent to prior art |
| fresh electrode | 76 | 24 | 1.00 | — |
| (6) | 82 | 18 | 0.75 | equivalent to prior art |

In this instance, the metal admixed in the adhesive also causes the temperature to rise with consumption of the electrode and its resistance also increases. This behavior is illustrated in FIG. 2. As the length of the electrode decreases, resistance of the carbon electrode decreases. On the other hand, the discharge section approaches the joint portion to elevate the temperature at that portion. Hence, resistance at the joint portion increases, thereby restricting the resistance drop of the electrode as a whole. This also provides the effect of restricting the change in resistance occurring in the carbon electrode discharge circuit of the conventional electrode, and constantly ensures stable discharge. Consequently, the electrode of the invention is free from change in the discharge current resulting from the change in resistance with the passage of time of use of the electrode in contrast to conventional electrodes, and hence, the present electrode is free from change in spectral composition. It is therefore possible, by the use of the electrode of the present invention, to accurately carry out the weathering test without adverse influence on the actions of fading and degradation of the testpiece.

During the discharge, the temperature at the joint portion increases with consumption of the carbon as shown in FIG. 3. This makes up for the decrease in the resistance due to the consumption of the carbon and restricts the change in resistance during the time the lamp is lit so that it becomes possible to realize a stable discharge. The relationship between the temperature and resistance of the metal contained in the adhesive is shown in FIG. 2. It can be seen that the resistance of the resin of the adhesive cooperates or compensates for the decrease in the resistance due to consumption of the carbon. Accordingly, the consumption can be restricted and the service life can be prolonged in comparison with the conventional electrode consisting of a single electrode. In addition the spectral composition of each testpiece, as one of the essential factors, is stable and is found to be perfectly equal to the conventional electrode at the initial stage of lighting.

Figure 6:
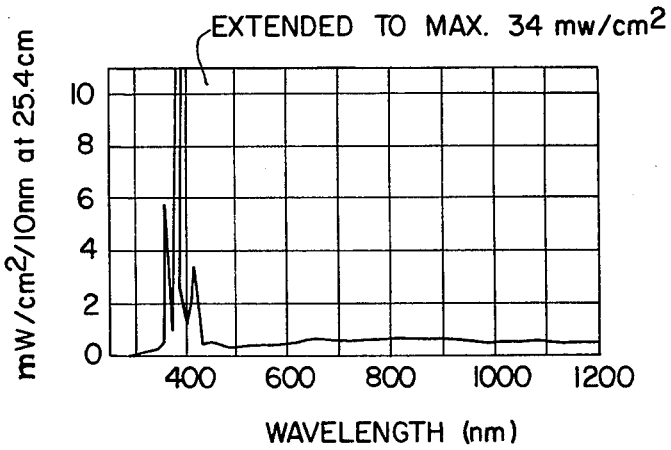
FIGS. 6 and 8 are diagrams each showing the spectral composition of the electrode of the present invention.
Figure 5:
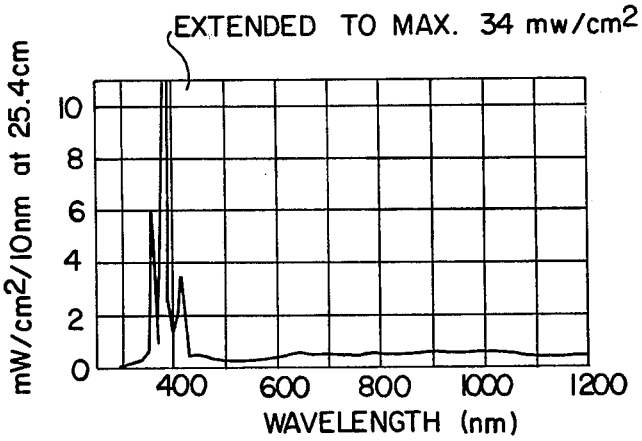
FIGS. 5 and 7 are diagrams each depicting the spectral composition of the conventional electrode.

FIG. 5 is a diagram of the spectral composition of the conventional U.V. carbon and FIG. 6 is a diagram of the spectral composition of the electrode of the present invention.

Figure 7:
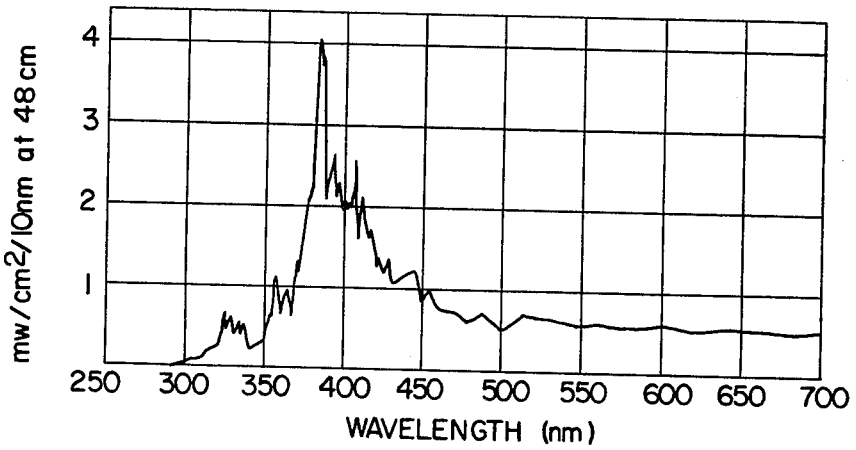
Figure 8:
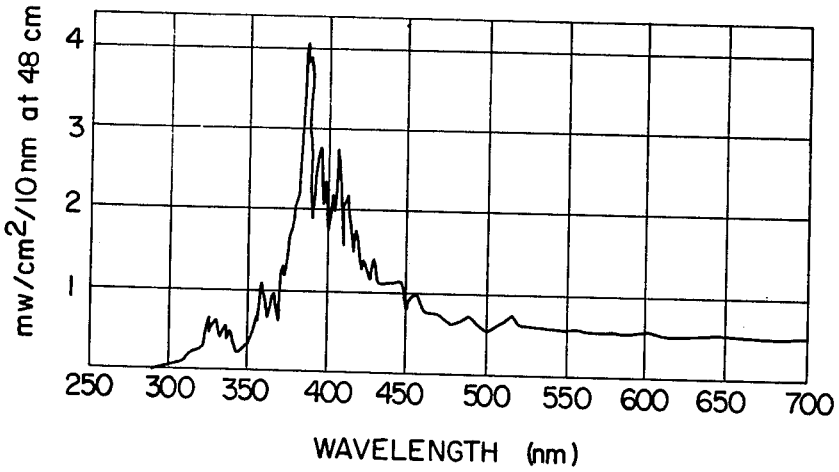

Also with respect to the sunshine carbon electrode, the spectral composition of the present invention is comparable to that of the conventional electrode by comparing FIG. 8 (the present electrode) with FIG. 7 (the conventional electrode).

Figure 4:
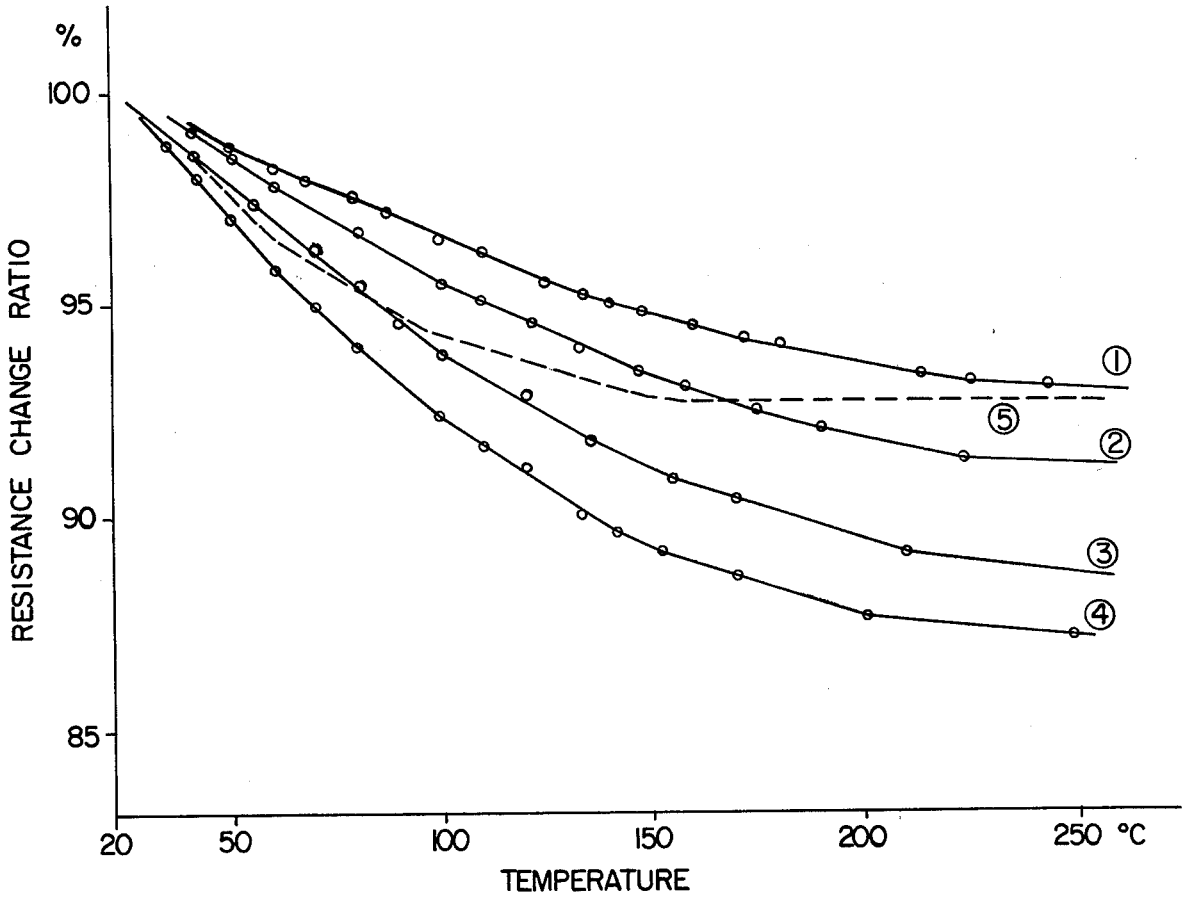
FIG. 4 is a diagram depicting the relationship between the temperature and the resistance change ratio of the electrode of the present invention versus the conventional carbon electrode.

FIG. 4 depicts the change in resistance with respect to the temperature rise between the electrode of the present invention and the conventional electrode. Electrodes (1) through (3) are obtained by joining carbon electrodes, each having a diameter of 13 mm, whereby the adhesive for the electrode (1) contains a small amount of C powder added to Ag powder (0.243 g), the adhesive for the electrode (2) contains a large amount of C powder added to Ag powder (0.421 g) and the electrode (3) consists of Ag powder, Al powder and C powder (0.206 g). The electrode (4) is a non-joint single electrode, and the electrode (5) is obtained by kneading C powder (0.007 g) with the resin and the solvent. The resistance measuring gap is 100 mm for each electrode.

As can be seen clearly from this graph, the conventional electrode (4) decreases in resistance with temperature rise whereas the electrodes (1), (2) and (3) of the present invention exhibit less change in resistance due to the temperature rise. This results from the fact that the resistance of the metal in the adhesive increases with the temperature rise, thereby compensating for the resistance change due to the temperature rise of the carbon.

For example, the resistance change ratio of the carbon alone (conventional electrode) is about 87% when the temperature is elevated from the normal temperature to 250° C. as the reference temperature, and the resistance change ratio is about 93% for the electrode (1) of the present invention using the adhesive, whereby the presence of the joint portion makes up for the resistance change of about 6%. It is possible, in accordance with the present invention, to obtain various characteristics of the temperature—resistance change ratio by suitably selecting the kind and amount of the metal to be contained in the adhesive.

When the carbon powder is used in combination with the resin, the change ratio is about 93% between 150° and 250° C. as shown from the curve of the electrode (5). It is possible also in this case to obtain various characteristics of the temperature—resistance change ratio by using carbon having a varying mesh size and changing the amount thereof to be added.

As described in the foregoing paragraph, it is possible, in accordance with the present invention to obtain an excellent electrode having a smaller consumption ratio than the conventional electrode by effectively utilizing the used electrodes or the cut tip of the electrodes. Hence, the present invention provides an ideal solution to the problem of disposal of the waste electrodes and is also extremely advantageous from the standpoint of preservation of resources and prevention of environmental pollution.

What is claimed is:

1. A carbon electrode for an arc lamp employed in weathering tests which comprises a plurality of carbon rods joined together lengthwise by the use of an adhesive, said adhesive comprising a metal powder, a binder resin bondable to carbon and a solvent for said resin, said adhesive increasing in resistance with increasing temperature so as to compensate for the decrease in resistance with reduction in length of said electrode as it is consumed, whereby a stable spectral distribution is emitted.

2. The carbon electrode according to claim 1 wherein said metal powder is selected from the group consisting of silver and aluminum powder.

3. The carbon electrode according to claim 1 wherein said resin is selected from the group consisting of an acrylic resin, epoxy resin, polystyrene resin, polyvinyl acetate and polyvinyl alcohol.

4. The carbon electrode according to claim 2 wherein the adhesive contains about 10% by weight resin, about 30% by weight solvent and about 60% by weight silver powder.

5. The carbon electrode according to claim 4 wherein the resin is an epoxy resin.

6. The carbon electrode according to claim 2, wherein the adhesive contains about 20% resin, about 60% solvent and about 20% aluminum powder.

7. The carbon electrode according to claim 6, wherein the resin is an epoxy resin.

8. The carbon electrode according to claim 1 wherein the joined area of said electrodes is reinforced by a reinforcing member comprising a ring into which the end portions of said electrodes are inserted.

* * * * *